US005254277A

United States Patent [19]

Gentit et al.

[11] Patent Number: 5,254,277

[45] Date of Patent: Oct. 19, 1993

[54] CORROSION INHIBITOR COMPOSITION FOR FORMULATED POLYOL ESTER FLUIDS

[75] Inventors: William F. Gentit, Weston, Conn.; Sydney H. Shapiro, Chicago, Ill.

[73] Assignee: Akzo N.V., Arnhem, Netherlands

[21] Appl. No.: 811,400

[22] Filed: Dec. 20, 1991

[51] Int. Cl.[5] ..... C10L 105/56

[52] U.S. Cl. ..... 252/51.5 R; 252/51.5 A; 252/392

[58] Field of Search ..... 252/56 S, 51.5 R, 51.5 A, 252/392

[56] References Cited

U.S. PATENT DOCUMENTS

| | | | |
|---|---|---|---|
| 3,360,465 | 12/1967 | Warman | 252/56 S |
| 3,657,129 | 4/1972 | Obermeier | 252/51.5 R |
| 3,694,382 | 9/1972 | Kleiman et al. | 252/56 S |
| 4,039,462 | 8/1977 | McCoy | 252/56 S |
| 4,049,563 | 9/1977 | Burrous | 252/56 S |
| 4,061,581 | 12/1977 | Leleu et al. | 252/56 S |
| 4,064,058 | 12/1977 | Walker | 252/56 S |
| 4,129,508 | 12/1978 | Friihauf | 252/51.5 R |
| 4,302,354 | 11/1981 | Giede et al. | 252/392 |
| 4,409,000 | 10/1983 | Le Suer | 252/51.5 R |
| 4,826,633 | 5/1989 | Carr et al. | 252/56 S |

*Primary Examiner*—Margaret Medley

*Attorney, Agent, or Firm*—Richard P. Fennelly; Louis A. Morris

[57] ABSTRACT

Corrosion inhibition in polyol ester lubricant compositions is achieved by the inclusion in the lubricant of a mixture of a hydroxyamine (e.g., bis(2-hydroxyethyltallowamine) and an alkyldiamine dicarboxylate (e.g., N-tallow-1,3-diaminopropane dioleate).

6 Claims, No Drawings

CORROSION INHIBITOR COMPOSITION FOR FORMULATED POLYOL ESTER FLUIDS

BACKGROUND OF THE INVENTION

Polyol ester basestocks are a known class of lubricant materials and find use, for example, in the lubrication of gas turbine engines. For example, U.S. Pat. No. 3,694,382 to Kleiman discloses an ester blend including esters of trimethylolpropane and dipentaerythritol formed from a mixture of aliphatic monocarboxylic acids. U.S. Pat. No. 4,049,563 to Burrous discloses a jet engine oil consisting of an ester of $C_4$–$C_{12}$ monocarboxylic acids, certain types of polyols, and a soluble methylphenylpolysiloxane. Walker in U.S. Pat. No. 4,064,058 describes a grease basestock including a blend of a normally liquid pentaerythritol ester and a neopentylglycol ester. Warman in U.S Pat. No. 3,360,465 discloses synthetic ester lubricant compositions of mixed pentaerythritol esters. More recently, U.S. Pat. No. 4,826,633 to Carr describes an improved synthetic ester lubricant formed by reacting either trimethylolpropane or pentaerythritol with a mixture of certain aliphatic monocarboxylic acids.

Formulated polyol ester compositions which contain certain additive packages, to achieve certain desired properties and characteristics are also known. Typical additive packages are shown in U.S. Pat. Nos. 4,124,513 and 4,141,845, for example, which describe packages based on an alkylphenyl or alkarylphenyl naphthylamines, a dialkyldiphenylamine, a polyhydroxyanthraquinone, a hydrocarbylphosphate ester with an S-alkyl-2-mercaptobenzotriazole, or an N-alkyl-benzothiazole-2-thione. U.S. Pat. No. 4,440,657 describes another additive package comprising t-butylphenyl substituted phosphate and alkylamine compounds.

DESCRIPTION OF THE INVENTION

The present invention relates to a composition for corrosion inhibition when the aforementioned types of polyol ester fluids, e.g., formulated polyol ester fluids, are utilized in an internal combustion engine, e.g., a gas turbine.

The polyol ester basestock and any conventional additive package which might be selected, exclusive of the novel composition of this invention, is well known to persons of ordinary skill in the art and reference is made to the above-mentioned issued U.S. patents as providing guidance in regard to components of this type to select.

The corrosion inhibitor composition of this invention can be used on the foregoing, known polyol ester lubricant compositions at levels of from about 0.1 to about 5.0% by weight of the composition with levels of about 0.3%±0.2% being most preferred.

The corrosion inhibitor composition of the present invention comprises a mixture of at least one hydroxyamine with at least one alkyldiamine carboxylate, i.e., a mono and/or dicarboxylate. The weight ratio of the former to the latter can vary from about 0.05:1 to about 2:1 with values of about 0.5±0.3:1 being most preferred.

The hydroxyamine compound which forms one component of the novel corrosion inhibitor composition has been previously proposed as one component of a composition intended to be added to fuel oil to reduce carburetor deposits (see Reissue U.S. Pat. No. 32,174 to LeSuer). Preferred hydroxyamines to use have the formula

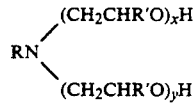

where x and y can each be integers whose sum ranges from 2 to 5, and R′ is hydrogen, methyl, ethyl or phenyl, and R is higher alkyl-containing (e.g., $C_8$–$C_{24}$ alkyl, $R'OCH_2CH_2CH_2$, where R′ is $C_4$ to $C_{24}$ alkyl, and $R''CONHCH_2CH_2CH_2$, where R″ is $C_7$ to $C_{23}$ alkyl). Certain commercially available products within this described class are available from Akzo Chemicals Inc. under the registered trademark ETHOMEEN.

The second component of the corrosion inhibitor composition of the present invention is an alkyldiamine dicarboxylate of the general formula $$RNH(CH_2)_nNH_2 \cdot 2R'COOH$$

where R is long chain alkyl-containing (as defined above for the hydroxyamine compound), R′ is long chain alkyl or alkenyl (e.g., containing from 7 to 23 carbon atoms), and n is an integer of up to about 6. A preferred material of this type is N-tallow-1,3-diaminopropane dioleate which is available under the trademark DUOMEEN ® TDO from Akzo Chemicals Inc.

The present invention is further illustrated by the Examples which follow.

EXAMPLES 1-2

To the lubricant described below were added, at 0.3 percent by weight, a 1:2 weight ratio of N-tallow-1,3-diaminopropane dioleate (DUOMEEN ® TDO brand) and bis(2-hydroxyethyl)tallowamine (ETHOMEEN ® T/12 brand). The other components of the polyester lubricant were as described in military specification MIL-L-23699, Qual. Ref. No. O-1K. Such lubricants contain a pentaerythritol ester base stock made from a mixture of aliphatic monocarboxylic acids containing 4-12 carbon atoms and an additives package such as described in U.S. Pat. Nos. 4,124,513, 4,141,845, and 4,440,657.

The resulting oil (labeled "Lubricant" in the Table below) was then tested against the lubricant, labeled "control" in the following Table, which did not contain the 1:2 weight ratio blend described above.

| Test/Parameter | Requirement | Lubricant | Control |
|---|---|---|---|
| 1. Viscosity, $10^{-6}m^2$/sec, cs | | | |
| at 38° C. | Report | 26.88 | 26.69 |
| at 98° C. | 5.0 to 5.5 | 5.00 | 5.02 |
| 2. Total Acid Number, mg KOH/g | 0.50 max. | 0.13 | 0.05 |
| 3. Sediment, mg/L | 10.0 max. | 1.25 | 1.27 |
| 4. Corrosion & Oxidation Stability, | | | |

-continued

| Test/Parameter | Requirement | Lubricant | Control |
|---|---|---|---|
| 72 hours at 204° C. | | | |
| Viscosity chg at 38° C., % | −5 + 25 | 16.16 | 15.07 |
| Total Acid Number chg, mg KOH/g | 2.0 | 0.47 | 0.99 |
| Contamination, mg/100 ml | 50 | 9.40 | 2.7 |
| Metal weight change, mg/cm$^2$ | | | |
| Steel | ±0.20 | +0.01 | +0.01 |
| Silver | ±0.20 | −0.01 | +0.01 |
| Aluminum | ±0.20 | +0.01 | −0.01 |
| Magnesium | ±0.20 | +0.01 | +0.01 |
| Copper | ±0.40 | −0.18 | −0.07 |
| 5. Thermal Stability & Corrosivity 96 hrs at 274° C. | | | |
| Viscosity chg at 38° C., % | ±5.0 | +0.61 | −0.49 |
| Total Acid Number chg, mg KOH/g | 6.0 | 4.09 | 2.67 |
| Metal Weight change, mg/cm$^2$ | ±4.0 | +0.07 | −0.26 |
| 6. Thermal Stability, 96 hrs at 274° C. | | | |
| Viscosity chg at 38° C., % | Report | +1.02 | +0.82 |
| Total Acid Number chg, mg KOH/g | Report | 4.88 | 4.02 |
| 7. Ball Corrosion Test | | | |
| New Oil | 75% Pass | 95% Pass | Fail |
| Stressed Oil* | 75% Pass | 100% Pass | Fail |
| 8. Four-Ball Test, wear scar, dia., mm | | | |
| New Oil (avg. of 3) | | | |
| 10 kg load | Report | 0.253 | 0.337 |
| 40 kg load | Report | 0.468 | 0.380 |
| Stressed Oil* (avg. of 3) | | | |
| 10 kg load | Report | 0.237 | ** |
| 40 kg load | Report | 0.444 | ** |

*produced by subjecting the Lubricant to the 204° C. corrosion and oxidation stability test of MIL-L-23699D.
**not tested.

The performance of the Lubricant in the Ball Corrosion Test, used to measure the corrosion inhibiting qualities of the oil, passed the requirements in both the new and "stressed" state. The performance of the oil in the 204° C. Corrosion and Oxidation Stability Test, in the 274° C. Thermal Stability and Corrosivity Test, and in the 274° C. Thermal Stability Test provided comparable results to those obtain in the Control oil alone. These results indicate that the additive package did not compromise the performance characteristics of the test fluid. The physical and chemical characteristics of the Lubricant, i e. viscosity, sediment and total acid number, were measured and meet the MIL-L-23699 specification requirements for those parameters. Finally, antiwear tests were run on the Lubricant, both new and "stressed" samples. The Four-Ball Wear Test was used in this evaluation. It was run at a speed of 1200 rpm for one hour using either a 10 or 40 kilogram load. The data obtained indicated that the corrosion inhibiting package did not change the Four-Ball wear scar diameter from that of the Control lubricant to any significant degree.

The significance of the results obtained in this evaluation of the corrosion inhibiting additive of the invention are twofold. First, the additives provide the required corrosion protection in both the new oil and "stressed" oil state. Second, the additive did not detract from the inherent MIL-L-23699D performance properties of the Control oil into which it was blended.

The foregoing is intended to illustrate certain characteristics and embodiments of the invention and, for that reason, should not be construed in a limiting sense. The scope of protection sought is set forth in the claims which follow.

We claim:

1. A polyol ester lubricant composition which comprises a predominant amount of a polyol ester basestock and an effective amount range from about 0.1% to about 5.0% by weight of the composition for corrosion inhibition of a mixture of a hydroxylamine compound and an alkyldiamine dicarboxylate in a weight ratio of from about 0.5:1 to about 2:1 wherein the hydroxylamine compound is of the formula

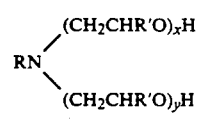

where x and y are integers whose sum ranges from 2 to 5, R' is selected from the group consisting of hydrogen, methyl, ethyl and phenyl, and R is selected from the group consisting of $C_8$ to $C_{24}$ alkyl, $R'OCH_2CH_2CH_2$, where R' is $C_6$ to $C_{24}$ alkyl, and $R''CONHCH_2CH_2CH_2$, where R'' is $C_7$ to $C_{23}$ alkyl and wherein the alkyldiamine dicarboxylate is of the formula $$RNH(CH_2)_nNH_2 \cdot 2R'COOH$$

where R is $C_7$ to $C_{23}$ alkyl-containing, R' is long chain alkyl or alkenyl, and n is an integer of up to about 6.

2. A composition as claimed in claim 1 wherein the amount ranges from about 0.1% to about 0.5% by weight of the composition.

3. A composition as claimed in claim 2 wherein the hydroxyamine and alkyldiamine dicarboxylate are present in a weight ratio of from about 0.2:1 to about 0.8.

4. A composition as claimed in claim 1 wherein the hydroxyamine compound is bis(2-hydroxyethyl)tallowamine and the alkyldiamine dicarboxylate is N-tallow-1,3-diaminopropane dioleate.

5. A composition as claimed in claim 2 wherein the hydroxyamine compound is bis(2-hydroxyethyl)tallowamine and the alkyldiamine dicarboxylate is N-tallow-1,3-diaminopropane dioleate.

6. A composition as claimed in claim 3 wherein the hydroxyamine compound is bis(2-hydroxyethyl)tallowamine and the alkyldiamine dicarboxylate is N-tallow-1,3-diaminopropane dioleate.

* * * * *